US011905598B2

(12) United States Patent
Iwase et al.

(10) Patent No.: US 11,905,598 B2
(45) Date of Patent: Feb. 20, 2024

(54) COATING METHOD

(71) Applicant: FUJIFILM Corporation, Tokyo (JP)

(72) Inventors: Eijiro Iwase, Minamiashigara (JP); Keio Okano, Minamiashigara (JP); Katsuyuki Nukui, Minamiashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 17/902,588

(22) Filed: Sep. 2, 2022

(65) Prior Publication Data

US 2023/0002907 A1 Jan. 5, 2023

Related U.S. Application Data

(63) Continuation of application No. PCT/JP2021/005584, filed on Feb. 16, 2021.

(30) Foreign Application Priority Data

Mar. 5, 2020 (JP) ..... 2020-037471

(51) Int. Cl.
*C23C 18/44* (2006.01)
*C23C 18/16* (2006.01)

(52) U.S. Cl.
CPC ..... *C23C 18/44* (2013.01); *C23C 18/166* (2013.01); *C23C 18/1641* (2013.01)

(58) Field of Classification Search
None
See application file for complete search history.

(56) References Cited

U.S. PATENT DOCUMENTS

| | | | | |
|---|---|---|---|---|
| 6,065,424 | A | 5/2000 | Shacham-Diamand et al. | |
| 2002/0192388 | A1 | 12/2002 | Yamauchi | |
| 2005/0130397 | A1* | 6/2005 | Bentley | C23C 18/30 438/584 |
| 2006/0134318 | A1 | 6/2006 | Hudd et al. | |
| 2016/0102415 | A1 | 4/2016 | Sebe | |

FOREIGN PATENT DOCUMENTS

| | | | |
|---|---|---|---|
| JP | 11-510219 | A | 9/1999 |
| JP | 2001-11643 | A | 1/2001 |
| JP | 2002-233812 | A | 8/2002 |
| JP | 2004-35996 | A | 2/2004 |
| JP | 2006-16659 | A | 1/2006 |
| JP | 2006-516818 | A | 7/2006 |

(Continued)

OTHER PUBLICATIONS

Machine Translation of JP 2016-039268 A (Year: 2016).*

(Continued)

*Primary Examiner* — Shamim Ahmed
*Assistant Examiner* — Bradford M Gates
(74) *Attorney, Agent, or Firm* — Birch, Stewart, Kolasch & Birch, LLP

(57) ABSTRACT

An object is to coat a target position on a substrate with a dense film. In order to achieve the object, while a substrate on which a base containing a coating material is formed is transported, an auxiliary agent is applied to the substrate, and then a main agent containing a coating material is applied to the substrate to react the main agent with the auxiliary agent, so that a portion on the substrate where the base is formed is coated with the coating material.

16 Claims, 2 Drawing Sheets

(56) References Cited

FOREIGN PATENT DOCUMENTS

| | | | |
|---|---|---|---|
| JP | 2008-296082 | A | 12/2008 |
| JP | 2016-39268 | A | 3/2016 |
| WO | WO 2015/060342 | A1 | 4/2015 |

OTHER PUBLICATIONS

Machine Translation of JP 2008-296082 A (Year: 2008).*
Chinese Office Action for corresponding Chinese Application No. 202180018554.2, dated Feb. 2, 2023, with a partial English translation.
Japanese Notice of Reasons for Refusal for corresponding Japanese Application No. 2022-505097, dated Apr. 4, 2023, with an English translation.
International Preliminary Report on Patentability and Written Opinion of the International Searching Authority (Forms PCT/IB/326, PCT/IB/373 and PCT/ISA/237) for International Application No. PCT/JP2021/005584, dated Sep. 15, 2022, with an English translation.
International Search Report (Form PCT/ISA/210) for International Application No. PCT/JP2021/005584, dated May 11, 2021, with an English translation.

* cited by examiner

COATING METHOD

CROSS-REFERENCE TO RELATED APPLICATIONS

This application is a Continuation of PCT International Application No. PCT/JP2021/005584 filed on Feb. 16, 2021, which claims priority under 35 U.S.C. § 119(a) to Japanese Patent Application No. 2020-037471 filed on Mar. 5, 2020. Each of the above applications is hereby expressly incorporated by reference, in its entirety, into the present application.

BACKGROUND OF THE INVENTION

1. Field of the Invention

The present invention relates to a coating method for coating a substrate with a hard coating, plating, or the like.

2. Description of the Related Art

There are various methods as a technology for coating surfaces of various substrates such as film substrates with two-pack reaction liquid.

For example, plating is also one of the methods, and a method of applying a highly reactive plating liquid by spraying has been proposed.

For example, JP2004-035996A describes a method of manufacturing a plated and coated product, including a step of forming an undercoat on the entire surface of a substrate by spray coating, a step of forming an electroless plating layer on the entire surface of the undercoat by coating type electroless plating, and a step of forming a protective film and/or a toned coating film on a surface of the electroless plating layer by spray coating, in which the steps are continuously performed by a coating robot under automatic control.

Here, JP2004-035996A describes, as a preferable method of forming an electroless plating layer, applying two liquids, i.e., a solution containing a silver ion such as an aqueous solution of a water-soluble silver salt such as silver nitrate and a reducing liquid, by spray coating using a double head spray gun.

In addition, JP2006-016659A describes a two-pack electroless silver plating liquid consisting of two liquids, i.e., a silver-containing aqueous solution containing a silver compound and ammonia and a reducing agent-containing aqueous solution containing a reducing agent, in which predetermined ethyleneamines are contained in the silver-containing aqueous solution and/or the reducing agent-containing aqueous solution. JP2006-016659A describes an electroless silver plating method in which using the two-pack electroless silver plating liquid, the silver-containing aqueous solution and the reducing agent-containing aqueous solution are simultaneously sprayed to an object to be plated with the use of a spray gun such as a double head spray gun or a concentric spray gun.

According to the method of JP2006-016659A, the silver-containing aqueous solution and the reducing agent-containing aqueous solution prepared separately are simultaneously sprayed to a surface of the object to be plated so that the spraying positions match, and thus a reduction reaction occurs at the position where both the solutions are sprayed and leads to the formation of a silver plating film.

SUMMARY OF THE INVENTION

In the methods described in JP2004-035996A and JP2006-016659A, a two-pack plating liquid consisting of an aqueous solution containing silver as a main agent and an aqueous solution containing a reducing agent as an auxiliary agent is simultaneously applied to mix the agents on a substrate, so that electroless plating is formed.

According to this method, since the main agent and the auxiliary agent of the plating liquid are not previously mixed, it is possible to prevent the precipitation of plating which causes the generation of foreign matter and clogging. Therefore, according to the methods described in JP2004-035996A and JP2006-016659A, the substrate can be coated with appropriate plating even with a highly reactive two-pack plating liquid.

Here, the plating which coats the substrate is desired to be dense.

For example, in JP2004-035996A, a plated product having uniform electromagnetic shielding properties can be produced, but it is preferable that the plating is dense to obtain more excellent electromagnetic shielding properties. In addition, in JP2006-016659A, a silver film which has excellent gloss and is free from discoloration and unevenness can be formed, but the denser the plating, the more suitably these effects can be obtained.

However, with the two-pack plating methods according to the related art, it may not be always possible to stably form a sufficiently dense plating film.

An object of the present invention is to solve such problems of the related art and provide a coating method with which a target position on a substrate can be coated with a dense film by using a two-pack reaction liquid consisting of a main agent and an auxiliary agent.

In order to solve the problems, the present invention has the following configuration.

[1] A coating method including: applying an auxiliary agent to a substrate on which a base containing a coating material is formed, and then applying a main agent containing a coating material to the substrate while transporting the substrate to react the main agent with the auxiliary agent, so that a portion on the substrate where the base is formed is coated with the coating material.

[2] The coating method according to [1], in which a main surface of the substrate and a transport direction of the substrate are matched, and the auxiliary agent and the main agent are applied to the substrate while the substrate is transported downward.

[3] The coating method according to [2], in which the auxiliary agent and the main agent are applied to the substrate while the substrate is transported downward in a vertical direction.

[4] The coating method according to any one of [1] to [3], in which in a space where the auxiliary agent and the main agent are applied to the substrate, the auxiliary agent and the main agent are applied to the substrate while a vapor pressure of a solvent contained in at least one of the auxiliary agent or the main agent is controlled.

[5] The coating method according to [4], in which the vapor pressure of the solvent in the space where the auxiliary agent and the main agent are applied to the substrate is 50% or greater of a saturated vapor pressure.

[6] The coating method according to [4] or [5], in which a gas containing the solvent is introduced into the space where the auxiliary agent and the main agent are applied to the substrate.

[7] The coating method according to any one of [4] to [6], in which the same solvent is used for the auxiliary agent and the main agent.

[8] The coating method according to any one of [1] to [7], in which the auxiliary agent and the main agent are applied to the substrate while a temperature of a space where the auxiliary agent and the main agent are applied to the substrate is controlled.

[9] The coating method according to any one of [1] to [8], in which the main agent is applied by spraying.

[10] The coating method according to any one of [1] to [9], in which the auxiliary agent is applied by spraying.

[11] The coating method according to any one of [1] to [10], in which the substrate is washed after the portion on the substrate where the base is formed is coated with the coating material.

[12] The coating method according to any one of [1] to [11], in which the auxiliary agent and the main agent are applied to the substrate while the substrate which is elongated is continuously transported.

[13] The coating method according to any one of [1] to [12], in which the substrate has the base on both sides, and the auxiliary agent and the main agent are applied to both surfaces of the substrate.

[14] The coating method according to any one of [1] to [13], in which the base has any one of a layer-like pattern covering an entire surface of the substrate, a planar pattern consisting of a plurality of planes spaced from each other, or a linear pattern consisting of one or more lines.

According to the present invention, it is possible to coat a target position on a substrate with a dense film by using a two-pack reaction liquid consisting of a main agent and an auxiliary agent.

DESCRIPTION OF THE PREFERRED EMBODIMENTS

Hereinafter, a coating method according to an embodiment of the present invention will be described in detail based on suitable examples shown in the accompanying drawings.

In the present invention, a numerical range expressed using "to" means a range including numerical values before and after "to" as a lower limit and an upper limit.

Figure 1:
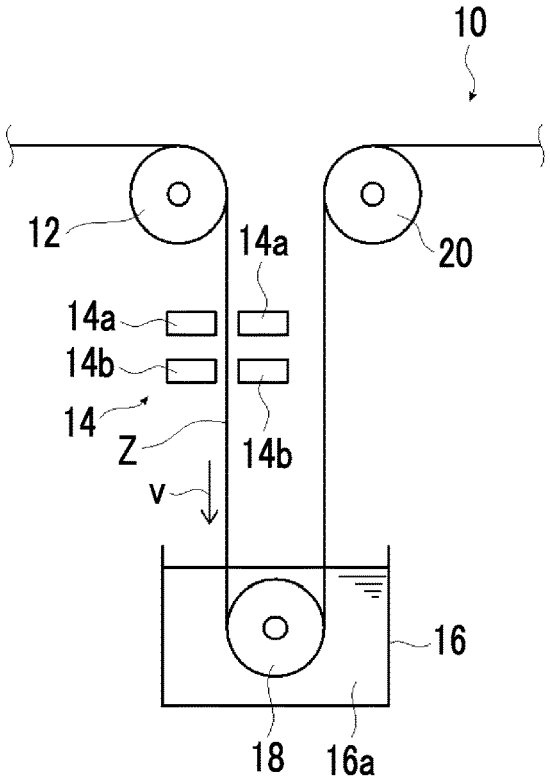
FIG. 1 is a diagram schematically showing an example of a device executing a coating method according to an embodiment of the present invention.

FIG. 1 schematically shows an example of a coating device executing a coating method according to the embodiment of the present invention.

In the coating device shown in FIG. 1, while an elongated substrate Z is transported in a longitudinal direction, a main agent and an auxiliary agent of a two-pack reaction liquid are separately applied to the substrate Z to mix and react the main agent with the auxiliary agent on the substrate Z, so that a predetermined position on the substrate Z is coated with a coating material.

In the coating device 10 shown in FIG. 1, while the substrate Z is guided to a guide roller 12 and transported downward (in the direction of the arrow v) in a vertical direction, a reaction liquid to be a coating material is applied in an applying portion 14 to coat at least a part of the substrate with the coating material.

The substrate Z coated with the coating material is then immersed and washed in a washing solution **16*a* in a washing tank 16, and the transport direction is changed upward by a guide roller 18 in the washing tank 16**.

The substrate Z transported upward is transported to the next step by a guide roller 20.

Here, in the coating method according to the embodiment of the present invention, a base containing a coating material is formed on the substrate Z. The coating with a coating material is performed on a part where the base is formed. That is, in the present invention, the base of the substrate Z contains a coating material, and determines a region to be coated with the coating material by the coating method according to the embodiment of the present invention on the substrate Z.

In addition, in the coating method according to the embodiment of the present invention, the reaction liquid to be a coating material is a two-pack reaction liquid consisting of a main agent containing a coating material and an auxiliary agent. In the present invention, while the substrate Z is transported, the auxiliary agent is first applied to the substrate Z, and the main agent containing the coating material is then applied to the substrate to mix and react the main agent with the auxiliary agent on the substrate Z, so that the substrate Z is coated with the coating material.

In the coating method according to the embodiment of the present invention, the substrate Z is not limited, and various sheet-like objects (plate-like objects, films) can be used.

Examples thereof include resin films such as a polyethylene terephthalate (PET) film, a polyethylene naphthalate (PEN) film, a cycloolefin polymer (COP) film, a polyimide film, a cycloolefin copolymer (COC) film, and a triacetyl cellulose (TAC) film, metal foils such as aluminum foil and copper foil, nonwoven fabric, and paper.

The thickness of the substrate Z is also not limited, and may be appropriately selected according to the use of the substrate Z coated with the coating material.

In the example shown in the drawing, as a preferable aspect, an elongated substrate Z is used and continuously coated with a coating material while being continuously transported in the longitudinal direction as in a so-called roll-to-roll treatment for a material to be treated. However, the present invention is not limited thereto.

That is, in the coating method according to the embodiment of the present invention, while a cut sheet-like substrate is transported, an auxiliary agent and a main agent may be applied as will be described later to coat a base forming portion of the substrate with a coating material.

The transportation speed of the substrate Z is also not limited, and may be appropriately set according to the state of the base to be described later, the reactivity of the main agent and the auxiliary agent, the amount of the main agent and the auxiliary agent to be applied, the coating material to be formed, and the like.

In consideration of productivity and the like, the transportation speed of the substrate Z is preferably 0.1 to 100 m/min, more preferably 1 to 50 m/min, and even more preferably 5 to 30 m/min.

In the coating method according to the embodiment of the present invention, a base containing a coating material is previously formed on the substrate Z.

As will be described later, the coating of the substrate Z with the coating material is performed at a position where the base is formed.

The base contains a coating material which coats the substrate Z. For example, in a case where the coating material is metal plating, the base is formed of a metal for plating. In addition, in a case where the coating material is a hard coating, the base is formed of a hard coating which coats the substrate. In addition, in a case where the coating material is an adhesive coating, a pressure-sensitive adhesive coating, or the like, the base is formed of an adhesive layer, a pressure-sensitive adhesive layer, or the like which coats the substrate.

As will be described in detail later, in the coating method according to the embodiment of the present invention, the substrate Z having such a base and the two-pack reaction liquid are used, and moreover, while the substrate Z is transported, the auxiliary agent is first applied to the substrate, and the main agent containing the coating material is then applied to the substrate. Accordingly, the main agent and the auxiliary agent are mixed and reacted on the substrate Z, and this makes it possible to coat the substrate Z with a dense coating material along the base.

The method of forming the base is not limited, and the base may be formed by a known method according to the material for forming the base, that is, the coating material for coating by the coating method according to the embodiment of the present invention. In a case where both sides of the substrate Z are coated with the coating material as in the example shown in the drawing, the base is formed on both sides of the substrate Z.

The method of forming the base and the coating method with the coating material to be described later may be the same or different from each other. For example, in a case where the coating material is metal plating, the base may be formed by a metal plating treatment. Otherwise, a base formed of a metal for plating may be formed by a film forming method such as sputtering with which a thin metal film can be formed.

The shape (planar shape) of the base is not limited, and various shapes can be used.

For example, the base may be formed like a layer covering the entire surface of the substrate Z or a layer covering a part of the substrate Z. That is, in the coating method according to the embodiment of the present invention, the entire surface of the substrate Z may be coated with the coating material.

Alternatively, a base having a planar pattern consisting of planes spaced from each other in the form of sea islands, such as a polka dot pattern or a checker pattern (checker board pattern), may be formed. In this case, the planar pattern may be formed regularly or irregularly.

Alternatively, the base may be formed in a lattice shape such as a mesh shape, a square lattice, a triangular lattice, and a hexagonal lattice (honeycomb shape).

Alternatively, the base may be formed in a stripe pattern (stripe shape). The thickness and/or spacing of the stripes in the stripe pattern may be uniform or non-uniform, and portions where the thickness and/or spacing are uniform and portions where thickness and/or spacing are non-uniform may be mixed.

Alternatively, the base may be formed in a linear pattern consisting of one line or a plurality of lines. The base having a linear pattern may have a straight line shape or a curved shape. Otherwise, it may be a line having a bent portion such as a polygonal line of zigzag, or may be in a linear pattern in which the above shapes are mixed. The thickness and spacing of the lines may be uniform or non-uniform, and portions where the thickness and the spacing are uniform and portions where the thickness and the spacing are non-uniform may be mixed.

These bases may be in a pattern having irregularities on the substrate Z.

Among these, a base having a planar pattern consisting of planes spaced from each other in the form of sea islands and a base having a linear pattern consisting of one line or a plurality of lines are suitably used.

As described above, the substrate Z on which such a base is formed is transported downward in the vertical direction by the guide roller 12 while being transported in the longitudinal direction, and a two-pack reaction liquid consisting of a main agent and an auxiliary agent is applied thereto in the applying portion 14.

Specifically, while the substrate Z is transported downward in the vertical direction, the auxiliary agent is first applied by a first applying unit 14*a*, and the main agent is then applied by a second applying unit 14*b* in the applying portion 14. Accordingly, the main agent and the auxiliary agent are mixed on the substrate Z (the surface of the substrate Z) and react with each other, and a portion on the substrate Z where the base is formed is coated with the coating material.

In the example shown in the drawing, both sides of the substrate Z are coated with the coating material, but the present invention is not limited thereto. That is, in the coating method according to the embodiment of the present invention, only one side of the substrate Z may be coated with the coating material.

In the coating method according to the embodiment of the present invention, the coating material which coats the substrate Z is not limited, and various materials can be used as long as the coating material which coats the substrate Z can be generated by the reaction of two liquids, i.e., the main agent and the auxiliary agent.

Examples of the coating material include electroless metal plating such as silver plating, copper plating, nickel plating, and cobalt plating, hard coatings such as curable acrylic resins and curable silanol-based resins, and pressure sensitive adhesives such as epoxy-based pressure sensitive adhesives and urethane-based pressure sensitive adhesives.

In the coating method according to the embodiment of the present invention, a two-pack reaction liquid consisting of a main agent and an auxiliary agent is reacted to coat the substrate Z with the coating material.

The main agent contains the coating material. The auxiliary agent contains at least one of a component which reacts with the coating material of the main agent to generate the coating material, a component which accelerates the generation of the coating material, a component which accelerates the bonding between the coating materials, a component which stabilizes the coating material, or a component which causes the coating materials to react with each other.

For example, in a case where the coating material is electroless metal plating, the main agent contains a metal ion for plating, an additive (stabilizer) which improves the stability of the metal ion, a pH adjuster, and the like, and the auxiliary agent contains a reducing agent and the like. The kind of the metal ion for plating contained in the main agent can be appropriately selected according to the kind of the metal to be precipitated, and examples thereof include a silver ion, a copper ion, a nickel ion, and a cobalt ion. A compound such as silver nitrate which dissolves in water and generates the above ions is added to the main agent.

In a case where the coating material is a hard coating, e.g., in a case where the substrate Z is coated with a silane film, the main agent contains a material such as alkoxysilane to be a hard coating, and the auxiliary agent contains a curing agent.

In a case where the coating material is a pressure sensitive adhesive, e.g., in a case where the substrate Z is coated with a urethane film, the main agent contains a material such as a urethane-based resin which has pressure sensitive properties, and the auxiliary agent contains a curing agent which accelerates the reaction of a terminal isocyanate group.

The main agent and the auxiliary agent each are a solution in which components to be contained are dissolved in a solvent.

The solvent is not limited, and various solvents capable of dissolving the components can be used depending on the coating material. The solvent is preferably water in consideration of the environment. That is, the main agent and the auxiliary agent are preferably aqueous solutions.

In addition, the solvents of the main agent and the auxiliary agent may be the same or different from each other. The solvents of the main agent and the auxiliary agent are preferably the same in consideration of the control of the atmosphere of an applying space to be described later where the main agent and the auxiliary agent are applied. That is, in a case where one kind of solvent is used for both the main agent and the auxiliary agent, it is preferable that the same solvent is used for the main agent and the auxiliary agent. In addition, in a case where a plurality of kinds of solvents are used for both the main agent and the auxiliary agent, it is preferable that the same solvent is used for the main agent and the auxiliary agent, and it is more preferable that the ratio of each solvent is the same.

As described above, in the coating method according to the embodiment of the present invention, the substrate Z having a base containing a coating material and the two-pack reaction liquid are used, and moreover, the auxiliary agent is first applied to the substrate, and the main agent containing the coating material is then applied to mix and react the main agent with the auxiliary agent on the substrate Z, so that the substrate Z can be coated with the dense coating material along the base.

In a case where the surface of the substrate is coated with the coating material by using the two-pack reaction liquid consisting of the main agent and the auxiliary agent, the mixing properties of the two liquids is important. In particular, the more reactive the liquids, the more important it is to mix the two liquids.

However, in a case where the main agent and the auxiliary agent are previously mixed, the coating material precipitates at that time and causes the generation of foreign matter and clogging in the pipes and the storage tank in the course of the operation.

Regarding this, as shown in JP2004-035996A and JP2006-016659A, in a case where the main agent and the auxiliary agent are simultaneously applied through different systems and mixed on the substrate, it is possible to prevent the generation of foreign matter and clogging.

However, the inventors found that in order to form a film with a highly reactive liquid such as electroless plating, the affinity of the auxiliary agent for the substrate, the reaction state of the two liquids, and the substrate are important. The reason for this was found to be that in a case where two highly reactive liquids are applied and mixed on the substrate as described in JP2004-035996A and JP2006-016659A, the coating material precipitates on the gas-liquid interface side of the liquid film on the substrate simultaneously with its formation and is regarded as foreign matter, and the dense coating material cannot be formed.

Therefore, the inventors have conducted intensive studies, and as a result, found that as a method of coating a substrate with a dense coating material, in a case where a substrate Z on which a base containing a coating material is formed is used, an auxiliary agent for accelerating the reaction is first applied instead of simultaneous application of the main agent and the auxiliary agent to make the auxiliary agent adapt to the substrate Z (base) sufficiently, and the main agent containing the coating material is then applied, it is possible to solve the problems.

The base contains a coating material. The auxiliary agent reacts with the main agent containing the coating material and forms the coating material. That is, it is thought that the auxiliary agent has reactivity with the coating material to some extent and has high affinity for the coating material.

Therefore, by first applying the auxiliary agent to the substrate Z on which the base containing the coating material is formed, the auxiliary agent selectively adheres to the base and permeates the base while causing a slight reaction. In this state, in a case where the main agent is then applied, the reaction between the main agent and the auxiliary agent proceeds even inside the base, and the coating material is selectively formed in the portion where the base is formed.

As a result, according to the coating method according to the embodiment of the present invention, the substrate Z can be coated with the dense coating material along the base. The present invention is particularly suitable for a case where a highly reactive main agent and a highly reactive auxiliary agent are used, that is, a case where the substrate Z is desired to be rapidly coated with many dense coating materials. In addition, in a case where the base has a pattern structure as described above, it is possible to control the coating amount of the coating material in a pattern portion and a non-pattern portion by utilizing the permeation of the auxiliary agent in a depth direction of the base, and this also advantageously acts in optionally changing the in-plane coating properties.

In the coating method according to the embodiment of the present invention, in a case where the auxiliary agent is first applied to the substrate Z and the main agent is then applied to the substrate Z, the timing of the application of the main agent after the application of the auxiliary agent is not limited.

That is, as the timing of the application of the main agent to the substrate Z after the application of the auxiliary agent to the substrate Z, a timing at which the auxiliary agent sufficiently adapts to the base and the main agent and the auxiliary agent can be suitably mixed on the substrate Z may be appropriately set according to the kind of the coating material, the transportation speed of the substrate Z, the amount of the main agent and the auxiliary agent to be applied to the substrate Z, the state of the base formed on the substrate Z, the drying speed of the solvent of the auxiliary agent and the main agent, the leveling speed of the auxiliary agent and the main agent, and the like.

The main agent is applied to the substrate Z preferably after 0.01 to 120 seconds, more preferably after 0.1 to 60 seconds, and even more preferably after 0.5 to 30 seconds from the application of the auxiliary agent.

The method of applying the main agent and the method of applying the auxiliary agent in the applying portion 14, that is, the first applying unit 14*a* and the second applying unit 14*b* are not limited, and known applying methods can be used. Examples thereof include an ink jet method, a curtain coater method, a roller coater method, a spray method, a bar coater method, a dispenser method, and a die coater method.

Among these, a spray method is suitably used from the viewpoint that the main agent and the auxiliary agent can be suitably mixed on the substrate Z. As the spray method, various known methods such as a one-fluid spray method, a two-fluid spray method, an ultrasonic spray method, a capacitance spray method, and a centrifugal spray method can be used.

The method of applying the main agent and the method of applying the auxiliary agent may be the same or different from each other, and it is most preferable that both the main agent and the auxiliary agent are applied by a spray method.

Figure 2:
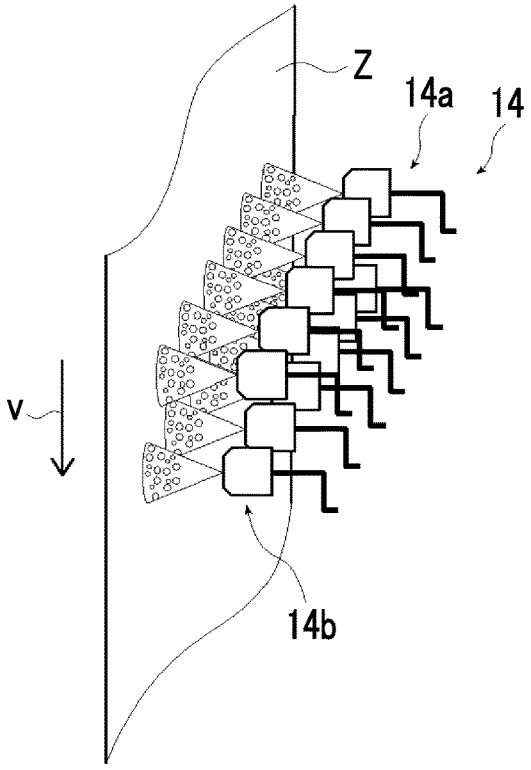
FIG. 2 is a diagram schematically showing an example of a configuration of an applying portion of the device shown in FIG. 1.

In the applying portion 14, one first applying unit 14*a* and one second applying unit 14*b* may be used, or as schematically shown in the spray method shown in the example of FIG. 2, a plurality of applying units may be arranged in the width direction of the substrate Z in accordance with the width of the substrate Z to apply the auxiliary agent and the main agent.

The width direction of the substrate Z is a direction orthogonal to the transport direction of the substrate Z.

The coating method according to the embodiment of the present invention is not limited to simultaneous application of all the auxiliary agents to the substrate Z and simultaneous application of all the main agents to the substrate Z. For example, the first applying units 14*a* arranged in the width direction of the substrate Z in the example shown in FIG. 2 may be disposed at different positions in the transport direction of the substrate Z. In addition, the second applying units 14*b* arranged in the width direction of the substrate Z in the example shown in FIG. 2 may be disposed at different positions in the transport direction of the substrate Z.

That is, in the coating method according to the embodiment of the present invention, the auxiliary agent may be applied to the substrate Z with a time lag, and/or the main agent may be applied to the substrate Z with a time lag according to the position where the coating device is installed, the configuration of the coating device, the base formed on the substrate Z, the kind of the coating material, the amount of the main agent and the auxiliary agent to be applied, the timing of the application of the auxiliary agent and the main agent, the drying speed of the solvent of the auxiliary agent and the main agent, and the like.

However, even in this case, the main agent is applied to the substrate Z after application of the auxiliary agent.

In addition, the application of the auxiliary agent and the main agent by the first applying unit 14*a* and the second applying unit 14*b* may be performed in the same pattern as the base according to the base formed on the substrate Z.

In the coating method according to the embodiment of the present invention, the two-pack reaction liquid is applied in the order of the auxiliary agent and the main agent while the substrate Z is transported. Here, in the coating method according to the embodiment of the present invention, it is preferable that the auxiliary agent and the main agent are applied while the substrate Z is transported downward.

In the coating device 10 in the example shown in the drawing, as the most preferable aspect, the transport direction of the substrate is set downward in the vertical direction (in the direction of the arrow v in the drawing).

Therefore, in the coating method according to the embodiment of the present invention, the substrate can be coated with a coating material which is free from unevenness and has high uniformity without the adhesion of foreign matter and the like.

Figure 3:
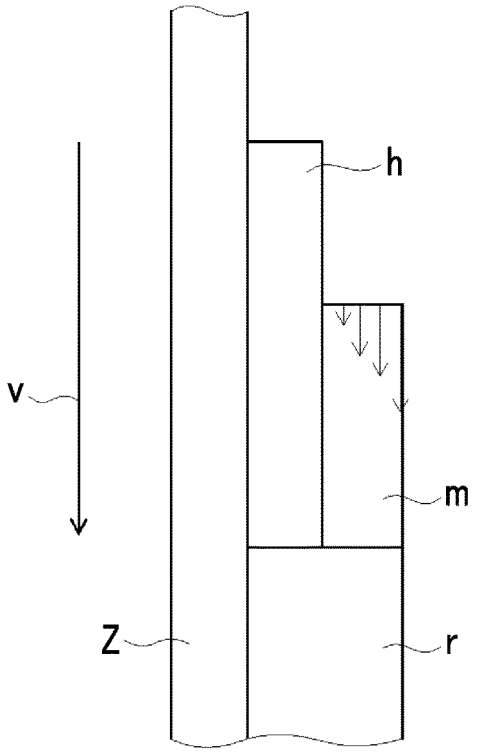
FIG. 3 is a schematic diagram for explaining an example of a method of applying a reaction liquid in the coating method according to the embodiment of the present invention.

FIG. 3 schematically shows a state of the substrate Z to which an auxiliary agent h is applied, and then a main agent m is applied while the substrate Z is transported downward in the vertical direction (in the direction of the arrow v in the drawing).

As described above, in the coating method according to the embodiment of the present invention, the auxiliary agent h is applied to the substrate Z, and then the main agent m is applied. After that, with the passage of time, that is, with the transport of the substrate Z, a mixed liquid r in which the auxiliary agent h and the main agent m are mixed is obtained.

Here, the flow velocity of the auxiliary agent h flowing downward by gravity is low on the side of the substrate Z due to the intermolecular force between the substrate Z and the auxiliary agent h, and increases with an increase in the distance from the substrate Z. That is, at the interface between the substrate Z and the auxiliary agent h, the difference between the transportation speed of the substrate Z and the flow velocity of the auxiliary agent h flowing downward is almost zero, and the substrate Z and the auxiliary agent h move downward almost together.

Similarly, the flow velocity of the main agent m flowing downward by gravity is also low on the side of the auxiliary agent h, and increases with an increase in the distance from the auxiliary agent h. At the interface between the auxiliary agent h and the main agent m, the difference between the flow velocity of the auxiliary agent h and the flow velocity of the main agent m is almost zero, and the auxiliary agent h and the main agent m move downward together.

This state occurs also in a case of the mixed liquid r, and as shown by the arrow in the drawing, the flow velocity decreases with a reduction in the distance from the substrate Z, and increases with an increase in the distance from the substrate Z.

Accordingly, on the substrate Z, the auxiliary agent h applied previously is in a state of staying on the substrate Z, and can sufficiently permeate the base formed on the substrate Z as described above. In addition, even in a state of the mixed liquid r, the difference between the transportation speed of the substrate Z and the flow velocity of the mixed liquid r is small.

That is, on the substrate Z, the main agent m and the auxiliary agent h are reacted without being affected by the flow of the mixed liquid r by gravity in a state where the auxiliary agent h is allowed to sufficiently permeate the base, and the substrate Z can thus be coated with the coating material in the portion where the base is formed.

The coating material is also generated even at a position spaced from the substrate Z. In particular, at the gas-liquid interface, the reactivity is high and the coating material is easily generated due to a concentration gradient.

The coating material generated at a position spaced from the substrate Z is likely to be regarded as foreign matter adhering to a surface of the coating material. However, as described above, the flow velocities of the auxiliary agent h, the main agent m, and the mixed liquid r flowing by gravity are high (the arrows in the drawing) at a position spaced from the substrate Z. Therefore, the coating material which may be regarded as foreign matter generated at a position spaced from the substrate Z is carried away by gravity, and can be prevented from adhering to the coating material with which the portion where the base is formed is coated.

That is, by applying the auxiliary agent h and the main agent m while transporting the substrate Z downward, the substrate can be coated with a coating material which is free from unevenness and has high uniformity without the adhesion of foreign matter and the like.

In a case where the auxiliary agent and the main agent are applied while the substrate Z is transported downward, the above-described actions and effects are exhibited regardless of the angle of the downward transport direction of the substrate Z. However, the above-described actions and effects are enhanced as the angle formed between the downward transport direction of the substrate Z and the horizontal direction is increased.

In consideration of this, the downward transport direction of the substrate Z preferably forms an angle of 30° or greater, more preferably 45° or greater, even more preferably 60° or greater with respect to the horizontal direction, and it is most preferable that the substrate is transported downward in the vertical direction as in the example shown in the drawing.

In a case where the auxiliary agent and the main agent are continuously applied while an elongated substrate is transported as shown in the example shown in the drawing, the transport direction of the substrate Z inevitably matches a main surface of the substrate Z. The main surface is the largest surface of a sheet-like object.

Even in a case where a cut sheet-like substrate is used, it is preferable that the transport direction of the substrate Z and the main surface of the substrate Z are matched as in the case where an elongated substrate is used.

In coating the substrate with the coating material by the reaction between the main agent and the auxiliary agent, the temperature of the main agent and the auxiliary agent on the substrate Z is preferably controlled in order to appropriately react the main agent with the auxiliary agent. For example, in electroless metal plating, the temperature of the main agent and the auxiliary agent on the substrate Z is preferably 15° C. to 70° C., and more preferably 20° C. to 50° C.

Regardless of electroless metal plating, by adjusting the temperature of the main agent and the auxiliary agent on the substrate Z to a predetermined temperature or higher, the auxiliary agent can suitably permeate the base formed on the substrate Z. In addition, the reaction rate between the main agent and the auxiliary agent can be increased, whereby productivity can be improved. In addition, by adjusting the temperature of the main agent and the auxiliary agent to a predetermined temperature or lower, the evaporation of the solvents from the main agent and the auxiliary agent which are solutions is suppressed, and thus it is possible to suppress the generation of the coating material which does not adhere to the substrate Z and is regarded as foreign matter.

That is, by applying the main agent and the auxiliary agent to the substrate Z while controlling the temperature of the main agent and the auxiliary agent to an appropriate temperature, it is possible to suitably prevent foreign matter from adhering to the surface of the coating material while appropriately coating the substrate Z with the coating material in the portion where the base is formed.

Here, in the coating method in which the auxiliary agent and the main agent are sequentially applied while the substrate Z is transported as in the present invention, it may be difficult to control the temperature of the main agent and the auxiliary agent on the substrate Z to a target temperature. In particular, in a case where the agents are applied by a spray method, it is difficult to appropriately control the temperature of the main agent and the auxiliary agent on the substrate Z.

That is, even in a case where the main agent and the auxiliary agent are applied after heating the substrate Z, in a case where the temperature of the main agent and the auxiliary agent is low, the temperature of the main agent and the auxiliary agent on the substrate Z immediately changes to that of the main agent and the auxiliary agent applied. This tendency is prominent as the substrate Z is thinner and the amount of the main agent and the auxiliary agent to be applied is larger.

In particular, this tendency is markedly shown in a case where the main agent and the auxiliary agent are applied by a spray method. That is, the spray method is a coating method which rapidly increases the specific surface area of the applied material. Therefore, even in a case where the temperature of the main agent and the auxiliary agent to be sprayed is increased, the temperature of the main agent and the auxiliary agent rapidly decreases due to the heat of vaporization. For example, in a case where the main agent and the auxiliary agent are applied by spraying at room temperature, the temperature of the main agent and the auxiliary agent decreases to be much lower than room temperature in the vicinity of the substrate Z, and the heat of the substrate Z is taken away.

Examples of the method of solving such problems and appropriately adjusting the temperature of the main agent and the auxiliary agent on the substrate Z include a method of controlling the vapor pressure of the solvent of the main agent and/or the auxiliary agent in a space where the main agent and the auxiliary agent are applied to the substrate Z.

For example, in a case where the main agent and the auxiliary agent are aqueous solutions, the water vapor pressure in a space where the main agent and the auxiliary agent are applied to the substrate Z is controlled.

Preferably, the temperature of the space where the main agent and the auxiliary agent are applied to the substrate Z is also controlled.

Accordingly, it is possible to prevent the vaporization of the main agent and the auxiliary agent applied to the substrate Z, and thus it is possible to appropriately control the temperature of the main agent and the auxiliary agent on the substrate Z.

Figure 4:
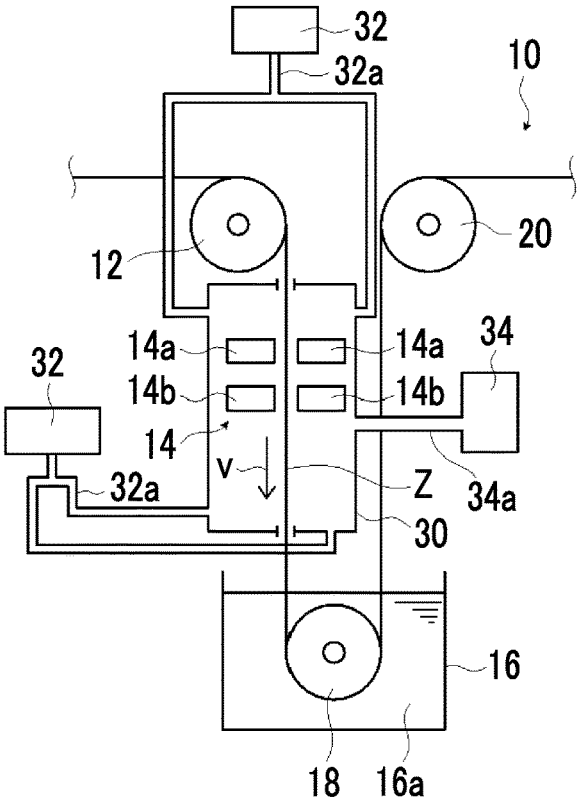
FIG. 4 is a diagram schematically showing another example of the device executing the coating method according to the embodiment of the present invention.

FIG. 4 shows an example of a method of controlling the vapor pressure of the solvent in a space where the main agent and the auxiliary agent are applied to the substrate Z and the temperature of the space. In the following description, the space where the main agent and the auxiliary agent are applied to the substrate Z is also referred to as "applying space" for convenience.

In this example, the applying space is covered with a casing 30. That is, in this example, the inside of the casing 30 is the applying space.

A supply unit 32 is connected to the casing 30 via a pipe 32*a*. In addition, an exhaust unit 34 is connected to the casing 30 via a pipe 34*a*.

The supply unit 32 supplies a gas containing the solvent of the main agent and the auxiliary agent into the casing 30 by temperature control. For example, in a case where the main agent and the auxiliary agent are aqueous solutions, the supply unit 32 supplies heated and humidified air into the casing 30. Examples of the gas containing the solvent include air and an inert gas.

The exhaust unit 34 evacuates the casing 30, thereby appropriately maintaining the pressure in the casing 30, that is, in the applying space, and preventing condensation of the solvent in the casing 30.

Using such a device, the temperature of the gas containing the solvent to be supplied to the casing 30 and the content of the solvent are controlled. Accordingly, the temperature in the applying space and the vapor pressure of the solvent of the main agent and the auxiliary agent can be maintained within a target range.

For example, in a case where the main agent and the auxiliary agent are aqueous solutions, the temperature and the water vapor pressure can be maintained within a target range in the applying space by controlling the temperature and the humidity of heated and humidified air to be supplied into the casing 30.

The vapor pressure of the solvent in the applying space is not limited, and may be appropriately set according to the method of applying the main agent and the auxiliary agent, the amount of the main agent and the auxiliary agent to be applied, the temperature of the applying space, the concentration of the solvent, the humidity for a case where the solvent is water, and the like.

The vapor pressure of the solvent in the applying space is preferably 50% or greater of the saturated vapor pressure, more preferably 60% or greater of the saturated vapor pressure, and even more preferably the saturated or supersaturated vapor pressure.

Basically, the temperature of the applying space may be appropriately set according to the temperature of the main agent and the auxiliary agent on a target substrate Z.

For example, in electroless metal plating, the temperature of the applying space is preferably 15° C. to 70° C., and more preferably 20° C. to 50° C. according to the above-described target temperature of the main agent and the auxiliary agent on the substrate Z.

It is preferable that the temperature of the gas containing the solvent and the content of the solvent in the gas containing the solvent are adjusted so that the solvent does not condense on the substrate Z.

In a case where the solvent of the main agent and the solvent of the auxiliary agent are different, and in a case where a plurality of solvents are used for the main agent and/or the auxiliary agent, the vapor pressure of the solvent most supplied to the applying space may be controlled.

In consideration of the vapor pressure of the applying space, the solvents of the main agent and the auxiliary agent are preferably the same. As described above, one or a plurality of kinds of solvents may be used for the main agent and the auxiliary agent as long as the solvents of the main agent and the auxiliary agent are preferably the same.

In the coating method according to the embodiment of the present invention, the temperature of the main agent and the auxiliary agent on the substrate Z can be controlled by controlling only one of the vapor pressure of the solvent in the applying space and the temperature of the applying space.

However, from the viewpoint that the temperature of the main agent and the auxiliary agent on the substrate Z can be more suitably controlled, both the vapor pressure of the solvent in the applying space and the temperature of the applying space are preferably controlled.

In the coating method according to the embodiment of the present invention, the temperature of the substrate Z conveyed into the applying space may be optionally controlled.

Furthermore, in the coating method according to the embodiment of the present invention, the temperature of the auxiliary agent to be supplied to the first applying unit 14*a* and/or the temperature of the main agent to be supplied to the second applying unit 14*b* may be optionally controlled.

The temperature in controlling the temperatures of the substrate Z, the auxiliary agent, and the main agent basically conforms to the temperature of the applying space described above.

The substrate Z in which the auxiliary agent and the main agent are sequentially applied in the applying space to coat the portion where the base is formed with the coating material is then, as a preferable aspect, immersed and washed in the washing solution 16*a* in the washing tank 16.

Accordingly, foreign matter such as an extra coating material adhering to the substrate Z is removed. In particular, in a case where the auxiliary agent and the main agent are sequentially applied while the substrate Z is transported downward as in the example shown in the drawing, the coating material which is regarded as foreign matter flows downward by gravity as described above, and thus the foreign matter can be more suitably removed by washing in the washing tank 16.

In addition, the reaction between the main agent and the auxiliary agent may be stopped by the above washing.

The washing solution is not limited, and may be appropriately selected according to the main agent and the auxiliary agent applied to the substrate Z.

Examples of the washing solution include a solvent of the main agent and the auxiliary agent, a liquid capable of dissolving the components contained in the main agent and the auxiliary agent, a liquid which stops the reaction between the main agent and the auxiliary agent, and a harmless liquid which does not dissolve the main agent and the auxiliary agent (for example, pure water).

The method of washing the substrate Z in which the portion where the base is formed is coated with the coating material is not limited to the immersion in the washing solution 16*a*, and various known methods such as washing by spraying with a washing solution to the substrate Z, washing by spraying with a gas, and wiping with a washing solution can be used.

Depending on the coating material which coats the substrate Z, instead of washing of the substrate Z, drying of the main agent and the auxiliary agent applied to the substrate Z, photocuring of the coating material, thermal curing of the coating material, and the like may be performed after the application of the auxiliary agent and the main agent in the applying portion 14.

These treatments may be performed instead of, before, or after washing of the substrate Z. In addition, these treatments, including washing, may be performed plural times.

The substrate Z is transported upward in the vertical direction through a folded transport path by the guide roller 18 disposed inside the washing tank 16, and is transported to the next subsequent step in the transport direction changed to horizontal by the guide roller 20.

The next step which is performed on the substrate Z in which the portion where the base is formed is coated with the coating material by the coating method according to the embodiment of the present invention is not limited. Examples of the next step include the same coating device, a winding device for the substrate Z, a protective layer forming device, a calender treatment device, a slit device, a foreign matter removing device, and a dust removing device.

Although the coating method according to the embodiment of the present invention has been described above in detail, the present invention is not limited to the above aspects, and various improvements and modifications may be made without departing from the gist of the present invention.

EXAMPLES

Hereinafter, the present invention will be described in detail with reference to examples. The present invention is not limited to the following specific examples.

Example 1

<Formation of Substrate and Base>

A PET film (COSMOSHINE A4300, manufactured by Toyobo Co., Ltd.) having a thickness of 100 μm was prepared. The PET film was cut into a square of 20×20 cm and prepared as a substrate.

A silver thin film serving as a base was formed on the entire surface of one side of the substrate using a commercially available sputtering device. The thickness of the silver thin film is estimated to be about 1 nm.

<Preparation of Main Agent and Auxiliary Agent>

30 mM (mol) of silver nitrate, 120 mM of ammonia water, and 140 mM of ethylenediamine were dissolved in pure water to prepare 200 mL (liter) of a main agent for performing electroless silver plating.

In addition, 150 mM of hydrazinehydrate was dissolved in pure water to prepare 200 mL of an auxiliary agent for performing electroless silver plating.

<Preparation of Spray Device>

Spray heads of a two-fluid spray (AM6, manufactured by ATOMAX. Co., Ltd.) were prepared, and a commercially available compressed air device (manufactured by AS ONE Corporation) and a diaphragm pump (QI-100-6T-P-S, manufactured by TACMINA CORPORATION) were connected to each spray head by a tube (φ6 mm) made of polytetrafluoroethylene (PTFE).

A ribbon heater was wrapped around the PTFE tube from the pump to the spray head to adjust the liquid temperature to 30° C.

Regarding the heads of the two-fluid spray, three heads were horizontally disposed as an upper stage, and three heads were horizontally disposed as a lower stage below the upper stage. The distance between the upper stage and the lower stage was 100 mm in a direction of the transport of the substrate by an XY stage to be described later.

The spraying rate was adjusted so that the auxiliary agent was sprayed at 10 ml/min per head from the three spray heads of the upper stage. In addition, the spraying rate was adjusted so that the main agent was sprayed at 10 ml/min per head from the three spray heads of the lower stage.

<Substrate Transport Unit>

The substrate on which the base was formed was fixed to a commercially available XY stage, and disposed so as to face the spray heads of the spray device. In addition, the XY stage was installed so as to move the substrate downward in a vertical direction.

The distance between the spray heads of the upper stage and the substrate and the distance between the spray heads of the lower stage and the substrate were all 70 mm.

<Applying Space>

The space (applying space), where the main agent and the auxiliary agent are applied to the substrate by the spray heads, was covered with a casing (see FIG. 4).

Heated and humidified air was supplied to the inside of the casing, and the atmosphere inside the casing was adjusted so that the temperature was adjusted to 30° C. and the humidity was adjusted to 60% RH (the vapor pressure was 60% of the saturated vapor pressure).

<Electroless Silver Plating>

While the substrate was moved downward in the vertical direction at 0.5 m/min, the auxiliary agent was sprayed from the spray heads of the upper stage, and the main agent was sprayed from the spray heads of the lower stage, so that the auxiliary agent and the main agent were applied to the substrate in this order. The amount of the auxiliary agent and the main agent to be applied was adjusted so that the thickness of the applied liquid before drying was about 30 μm.

The substrate to which the auxiliary agent and the main agent were sequentially applied was left for 30 seconds, and it was confirmed that the flow of the liquid film was visually stopped. After that, the substrate was washed with pure water to stop the reaction, and thus the substrate was coated with electroless silver plating.

The thickness of the silver plating was confirmed to be 1 μm.

Example 2

The substrate was coated with electroless silver plating in the same manner as in Example 1, except that the direction of the transport of the substrate by the XY stage was a downward direction at an angle of 30° in the vertical direction. The downward direction at an angle of 30° in the vertical direction is a downward direction at an angle of 60° in the horizontal direction.

Example 3

The substrate was coated with electroless silver plating in the same manner as in Example 1, except that the substrate was transport direction by the XY stage in the horizontal direction.

Example 4

The substrate was coated with electroless silver plating in the same manner as in Example 1, except that the atmosphere inside the casing was changed to an atmosphere with a temperature of 25° C. and a humidity of 20% RH (the vapor pressure was 20% of the saturated vapor pressure).

Example 5

In the formation of a base on the substrate, silver was sputtered using a mask having stripe-like openings with a width of 5 μm at intervals of 200 μm. Then, the mask was disposed so that the stripes were orthogonal to each other, and silver was sputtered in the same manner to form a mesh-like silver base.

The substrate was coated with electroless silver plating in the same manner as in Example 1, except that the substrate on which the above base was formed was used.

Example 6

24.6 g of silver nitrate, 46.2 g of sodium sulfite, and 40.5 g of sodium thiosulfate were dissolved in 700 g of pure water to prepare a main agent for performing electroless silver plating.

In addition, 47.52 g of sodium sulfite, 14.49 g of methylhydroquinone, 39.6 g of a dispersing agent (T-50, manufactured by Toagosei Co., Ltd.), 8.29 g of potassium carbonate, and 1.07 g of potassium hydroxide were dissolved in 600 g of pure water to prepare an auxiliary agent for performing electroless silver plating.

The substrate was coated with electroless silver plating in the same manner as in Example 1, except that the above main agent and auxiliary agent were used.

Comparative Example 1

The substrate was coated with electroless silver plating in the same manner as in Example 1, except that the auxiliary agent and the main agent were applied in reverse order so that the main agent was first applied to the substrate and the auxiliary agent was then applied to the substrate.

Comparative Example 2

The substrate was coated with electroless silver plating in the same manner as in Example 1, except that a substrate having no base (silver thin film) formed thereon was used. The substrate having no base formed thereon is a normal PET film.

[Evaluation]

The conductivity and surface properties of the substrate coated with electroless silver plating were evaluated.

<Conductivity>

The surface electrical resistance of the electroless silver-plated substrate was measured using a resistivity meter (LORESTA GP, manufactured by Nittoseiko Analytech Co., Ltd.). The denser the silver plating which coats the substrate, the lower the surface electrical resistance. The evaluation standards are as follows.

A case where the surface electrical resistance was less than 50Ω was evaluated as A.

A case where the surface electrical resistance was 50Ω or greater and less than 100Ω was evaluated as B.

A case where the surface electrical resistance was 100Ω or greater and less than 300Ω was evaluated as C.

A case where the surface electrical resistance was 300Ω or greater was evaluated as D.

<Surface Properties>

Using an optical microscope, the number of defects (surface-precipitated plating) in a 10 mm square visual field was counted. Defects were counted at 10 optional locations, and the evaluation was performed by the average of the number of defects. The evaluation standards are as follows.

A case where the number of defects was less than 5 was evaluated as A.

A case where the number of defects was 5 or greater and less than 10 was evaluated as B.

A case where the number of defects was 10 or greater and less than 50 was evaluated as C.

A case where the number of defects was 50 or greater was evaluated as D.

The results are shown in the following Table 1.

TABLE 1

(coating with electroless silver plating)

| | | | | Applying space | | Evaluation | |
|---|---|---|---|---|---|---|---|
| | Application order | Base | Transport direction | Temperature | Humidity | Conductivity | Surface properties |
| Example 1 | auxiliary agent → main agent | entire surface | downward in vertical direction | 30° C. | 60% RH | A | A |
| Example 2 | auxiliary agent → main agent | entire surface | downward at 30° | 30° C. | 60% RH | B | B |
| Example 3 | auxiliary agent → main agent | entire surface | horizontal direction | 30° C. | 60% RH | B | C |
| Example 4 | auxiliary agent → main agent | entire surface | downward in vertical direction | 25° C. | 20% RH | B | A |
| Example 5 | auxiliary agent → main agent | mesh-like | downward in vertical direction | 30° C. | 60% RH | A | A |
| Example 6 | auxiliary agent → main agent | entire surface | downward in vertical direction | 30° C. | 60% RH | A | A |
| Comparative Example 1 | main agent → auxiliary agent | entire surface | downward in vertical direction | 30° C. | 60% RH | D | A |
| Comparative Example 2 | auxiliary agent → main agent | none | downward in vertical direction | 30° C. | 60% RH | D | C |

Example 6 is different from other examples in reaction liquid of silver plating.

As shown in Table 1, according to the coating method according to the embodiment of the present invention, the substrate can be coated with silver plating which has good conductivity, that is, which is dense and has good surface properties with few defects.

In particular, as shown in Examples 1 to 3, by directing the transport direction of the substrate downward, the plating which is generated at the gas-liquid interface and does not adhere to the substrate falls down, and thus the substrate can be coated with silver plating which is denser and has higher conductivity and better surface properties. In addition, as shown in Examples 1 and 4, by adjusting the humidity of the applying space to 50% RH or greater, that is, 50% or greater of the saturated vapor pressure, it is possible to perform the coating with no decrease in temperature due to the vaporization heat of the spray, and the substrate can be coated with silver plating which is denser and has higher conductivity.

In addition, as shown in Example 5, according to the coating method according to the embodiment of the present invention, the substrate can be coated with silver plating which is dense and has high conductivity and good surface properties even in a case where the silver plating has a mesh-like pattern. Accordingly, it is found that the shape of the substrate obtains high robustness by spray coating. Moreover, as shown in Example 6, according to the coating method according to the embodiment of the present invention, the substrate can be coated with silver plating which is dense and has high conductivity and good surface properties regardless of the kinds of the main agent and the auxiliary agent.

In contrast, in Comparative Example 1 in which the main agent is first applied and the auxiliary agent is applied later, dense silver plating cannot be formed, and the conductivity is low. The reason for this is that the plating reaction between the plating liquid and the air interface is more vigorous than the reaction on the substrate. In addition, in Comparative Example 2 in which no base is formed, dense silver plating cannot be formed, and the conductivity is low. The reason for this is also that the reaction between the plating liquid and the air interface is more vigorous than the reaction on the substrate.

Example 7

<Formation of Substrate and Base>

A PET film (COSMOSHINE A4300, manufactured by Toyobo Co., Ltd.) was cut into a square shape of 20 cm×20 cm and prepared as a substrate.

A trimethoxy(2-phenylethyl)silane film was formed as a base on one side of the substrate.

First, 1 mL of trimethoxy(2-phenylethyl)silane (manufactured by Tokyo Chemical Industry Co., Ltd.) was put in a 3 mL (liter) vial bottle.

Next, the vial bottle and the substrate on which the base is formed were put in an oven at 130° C. and heated for 3 hours. Accordingly, the trimethoxy(2-phenylethyl)silane in the vial bottle evaporated, and a trimethoxy(2-phenylethyl) silane film was formed as a base on the surface of the substrate. The thickness of the film was 1 nm.

<Preparation of Main Agent and Auxiliary Agent>

As alkoxysilane, 3-glycidoxypropyltriethoxysilane (KBE-403, manufactured by Shin-Etsu Chemical Co., Ltd.) and tetraethoxysilane (KBE-04, manufactured by Shin-Etsu Chemical Co., Ltd.) were used. First, while an acetic acid aqueous solution as acidic water was vigorously stirred at 40° C., 3-glycidoxypropyltriethoxysilane was added dropwise into the acetic acid aqueous solution for 3 minutes. The acetic acid aqueous solution has an acetic acid concentration of 1 mass %. Next, the tetraethoxysilane was added into the acetic acid aqueous solution for 5 minutes under strong stirring, and then the stirring was continued at 40° C. for 3 hours to prepare a silanol aqueous solution.

The silanol aqueous solution was used as a main agent for forming a hard coating.

A curing agent (aluminum chelate (Aluminum Chelate D, manufactured by Kawaken Fine Chemicals Co., Ltd.)) and surfactants (RAPISOL a90, manufactured by NOF Corporation, and NAROACTY cl-95, manufactured by Sanyo Chemical Industries, Ltd.) were sequentially added to the acetic acid aqueous solution to prepare an auxiliary agent for forming a hard coating.

The main agent and the auxiliary agent were 200 mL each, so that a reaction liquid A and a reaction liquid B were 200 mL each and the total amount was 400 mL.

Specifically, in the total amount of the coating liquid, the amount of 3-glycidoxypropyltriethoxysilane added was 67.5 parts by mass, the amount of tetraethoxysilane added was 22.5 parts by mass, the amount of the curing agent added was 9 parts by mass, and the amount of the surfactant added was 1 part by mass (added by 0.5 parts by mass).

<Preparation of Spray Device>

The same spray device as that in Example 1 was prepared.

The spraying rate was adjusted so that the auxiliary agent was sprayed at 20 ml/min per head from the three spray heads of the upper stage. In addition, the spraying rate was adjusted so that the main agent was sprayed at 5 ml/min per head from the three spray heads of the lower stage.

<Substrate Transport Unit>

The same substrate transport unit as that in Example 1 was prepared.

<Applying Space>

The atmosphere of the space (applying space), where the main agent and the auxiliary agent are applied to the substrate by the spray heads, was adjusted as in Example 1.

<Formation of Hard Coating>

While the substrate was moved downward in the vertical direction at 0.5 m/min, the auxiliary agent was sprayed from the spray heads of the upper stage, and the main agent was sprayed from the spray heads of the lower stage, so that the auxiliary agent and the main agent were applied to the substrate in this order. The amount of the auxiliary agent and the main agent to be applied was adjusted so that the thickness of the applied liquid before drying was about 20 μm.

The substrate to which the auxiliary agent and the main agent were sequentially applied was left for 30 seconds, and it was confirmed that the flow of the liquid film was visually stopped. Then, drying was performed in an oven at 130° C. for 5 minutes to coat the substrate with a hard coating.

The thickness of the hard coating was confirmed to be 1 μm.

Example 8

The substrate was coated with a hard coating in the same manner as in Example 7, except that the transport direction of the substrate by the XY stage was a downward direction at an angle of 30° in the vertical direction. The downward direction at an angle of 30° in the vertical direction is a downward direction at an angle of 60° in the horizontal direction.

Example 9

The substrate was coated with a hard coating in the same manner as in Example 7, except that the transport direction of the substrate by the XY stage was performed in the horizontal direction.

Example 10

The substrate was coated with a hard coating in the same manner as in Example 7, except that the atmosphere inside the casing was changed to an atmosphere with a temperature of 25° C. and a humidity of 20% RH (the vapor pressure was 20% of the saturated vapor pressure).

Comparative Example 3

The substrate was coated with a hard coating in the same manner as in Example 7, except that the auxiliary agent and the main agent were applied in reverse order so that the main agent was first applied to the substrate and the auxiliary agent was then applied to the substrate.

Comparative Example 4

The substrate was coated with a hard coating in the same manner as in Example 7, except that a substrate having no base (trimethoxy(2-phenylethyl)silane film) formed thereon was used. The substrate having no base formed thereon is a normal PET film.

[Evaluation]

The hard coating properties and surface properties of the substrate coated with a hard coating were evaluated.

<Hard Coating Properties (Pencil Hardness)>

The pencil hardness was measured according to JIS K 5600. The higher the pencil hardness, the denser the hard coating and the better the hard coating properties.

<Surface Properties>

The surface properties were evaluated in the same manner as in Example 1.

The results are shown in the following Table 2.

TABLE 2

(coating with hard coating)

| | Application order | Base | Transport direction | Applying space Temperature | Applying space Humidity | Evaluation Pencil hardness | Evaluation Surface properties |
|---|---|---|---|---|---|---|---|
| Example 7 | auxiliary agent → main agent | entire surface | downward in vertical direction | 30° C. | 60% RH | 3 H | A |
| Example 8 | auxiliary agent → main agent | entire surface | downward at 30° | 30° C. | 60% RH | 2 H | B |
| Example 9 | auxiliary agent → main agent | entire surface | horizontal direction | 30° C. | 60% RH | H | C |
| Example 10 | auxiliary agent → main agent | entire surface | downward in vertical direction | 25° C. | 20% RH | 2 H | A |
| Comparative Example 3 | main agent → auxiliary agent | entire surface | downward in vertical direction | 30° C. | 60% RH | 2 B | A |
| Comparative Example 4 | auxiliary agent → main agent | none | downward in vertical direction | 30° C. | 60% RH | 4 B | C |

As shown in Table 2, according to the coating method according to the embodiment of the present invention, the substrate can be coated with a hard coating which has a high pencil hardness, that is, which is dense and has good surface properties with few defects.

In particular, as shown in Examples 7 to 9, by directing the transport direction of the substrate downward, the substrate can be coated with a hard coating which is denser and has a higher pencil hardness and better surface properties. The reason for this is that foreign matter caused by the hard coating material generated not on the substrate, but at the gas-liquid interface, is removed. In addition, as shown in Examples 7 and 10, by adjusting the humidity of the applying space to 50% RH or greater, that is, 50% or greater of the saturated vapor pressure, the substrate can be coated with a hard coating which is denser and has a higher pencil hardness. The reason for this is that the temperature of the spray liquid landing on the substrate does not drop due to the vaporization heat.

In contrast, in Comparative Example 3 in which the main agent is first applied and the auxiliary agent is applied later, a dense hard coating cannot be formed, and the pencil hardness is low. In addition, in Comparative Example 4 in which the base is not formed, a dense hard coating cannot be formed, and the pencil hardness is low.

From the above results, the effects of the present invention are obvious.

The present invention can be suitably used as a method for imparting and improving decorative properties, durability, conductivity, and the like in a sheet-like object used for various products.

EXPLANATION OF REFERENCES

10: coating device
12, 18, 20: guide roller
14: applying portion
14*a*: first applying unit
14*b*: second applying unit
16: washing tank
16*a*: washing solution
30: casing
32: supply unit
34: exhaust unit
Z: substrate
h: auxiliary agent
m: main agent
r: mixed liquid

What is claimed is:

1. A coating method comprising applying an auxiliary agent to a substrate on which a base containing a coating material is formed, and then applying a main agent containing the coating material to the substrate while transporting the substrate to react the main agent with the auxiliary agent, so that a portion on the substrate where the base is formed is coated with the coating material, wherein the main agent and the auxiliary agent are solutions, the main agent and the auxiliary agent are mixed to cause the main agent to react with the auxiliary agent on the substrate, in a space where the auxiliary agent and the main agent are applied to the substrate, the auxiliary agent and the main agent are applied to the substrate while a vapor pressure of a solvent contained in the auxiliary agent and the main agent is controlled, and a same solvent is used for the auxiliary agent and the main agent.

2. The coating method according to claim 1, wherein the auxiliary agent and the main agent are applied to the substrate while the substrate is transported downward.

3. The coating method according to claim 2,
wherein the auxiliary agent and the main agent are applied to the substrate while the substrate is transported downward in a vertical direction.

4. The coating method according to claim 2,
wherein the vapor pressure of the solvent in the space where the auxiliary agent and the main agent are applied to the substrate is 50% or greater of a saturated vapor pressure.

5. The coating method according to claim 2,
wherein the auxiliary agent and the main agent are applied to the substrate while a temperature of a space where the auxiliary agent and the main agent are applied to the substrate is controlled.

6. The coating method according to claim 2,
wherein the main agent is applied by spraying.

7. The coating method according to claim 1,
wherein the vapor pressure of the solvent in the space where the auxiliary agent and the main agent are applied to the substrate is 50% or greater of a saturated vapor pressure.

8. The coating method according to claim 7,
wherein a gas containing the solvent is introduced into the space where the auxiliary agent and the main agent are applied to the substrate.

9. The coating method according to claim 1,
wherein a gas containing the solvent is introduced into the space where the auxiliary agent and the main agent are applied to the substrate.

10. The coating method according to claim 1,
wherein the auxiliary agent and the main agent are applied to the substrate while a temperature of a space where the auxiliary agent and the main agent are applied to the substrate is controlled.

11. The coating method according to claim 1,
wherein the main agent is applied by spraying.

12. The coating method according to claim 1,
wherein the auxiliary agent is applied by spraying.

13. The coating method according to claim 1,
wherein the substrate is washed after the portion on the substrate where the base is formed is coated with the coating material.

14. The coating method according to claim 1,
wherein the auxiliary agent and the main agent are applied to the substrate while the substrate which is elongated is continuously transported.

15. The coating method according to claim 1,
wherein the substrate has the base on two sides, and the auxiliary agent and the main agent are applied to two surfaces of the substrate.

16. The coating method according to claim 1,
wherein the base has any one of a layer-like pattern covering an entire surface of the substrate, a planar pattern consisting of a plurality of planes spaced from each other, or a linear pattern consisting of one or more lines.

* * * * *